US006724349B1

(12) United States Patent
Baird et al.

(10) Patent No.: US 6,724,349 B1
(45) Date of Patent: Apr. 20, 2004

(54) SPLASHPLATE ANTENNA SYSTEM WITH IMPROVED WAVEGUIDE AND SPLASHPLATE (SUB-REFLECTOR) DESIGNS

(75) Inventors: Joseph Mark Baird, Sandy, UT (US); Sterling Hardison Redd, Salt Lake City, UT (US); Douglas Harry Ulmer, Midway, UT (US)

(73) Assignee: L-3 Communications Corporation, NY (US)

( * ) Notice: Subject to any disclaimer, the term of this patent is extended or adjusted under 35 U.S.C. 154(b) by 0 days.

(21) Appl. No.: 10/292,170

(22) Filed: Nov. 12, 2002

(51) Int. Cl.[7] ..... H01Q 19/19

(52) U.S. Cl. ..... 343/781 CA; 343/781 P; 343/781 R

(58) Field of Search ..... 343/781 CA, 781 P, 343/781 R, 772, 775, 779, 786, 840, 783

(56) References Cited

U.S. PATENT DOCUMENTS 5,767,815 A * 6/1998 Krebs ..... 343/786
5,959,590 A * 9/1999 Sanford et al. ..... 343/781 CA
5,973,652 A * 10/1999 Sanford et al. ..... 343/781 P

* cited by examiner

*Primary Examiner*—Tuyet T. Vo
(74) *Attorney, Agent, or Firm*—Perman & Green, LLP

(57) ABSTRACT

A splashplate antenna system configured using hybrid mode-matching techniques has improved secondary beam characteristics, including improved sidelobe performance, improved electric and magnetic plane correlation, reduced cross-polarization, improved electric and magnetic plane phase center correlation, and improved overall matching between the waveguide and the splashplate (sub-reflector). Internally, the waveguide contains a wall constructed from a series of varying dimensioned cross-sections that cause signals introduced to radiate in a multiple mode, Gaussian-like field pattern. The Splashplate is configured so that the waves received from the waveguide maintain the circular pattern symmetry, as well as other characteristics.

10 Claims, 8 Drawing Sheets

E- AND H-FIELD PATTERNS FOR THE $TE_{11}$ WAVEGUIDE ANTENNA MODE

E- AND H-FIELD PATTERNS FOR THE $TE_{11}$ WAVEGUIDE ANTENNA MODE

FIELD PATTERNS FOR HYBRID $TE_{11}$ + .25*$TM_{11}$ MODES

FIELD PATTERNS FOR HYBRID $TE_{11}$ + .25*$TM_{11}$ MODES

MULTI-MODE WAVEGUIDE FIELD PATTERN FOR REDUCED SPLASHPLATE RETURN LOSS

MULTI-MODE WAVEGUIDE FIELD PATTERN FOR REDUCED SPLASHPLATE RETURN LOSS

SPLASHPLATE ANTENNA SYSTEM WITH IMPROVED WAVEGUIDE AND SPLASHPLATE (SUB-REFLECTOR) DESIGNS

BACKGROUND OF THE INVENTION

1. Field of the Invention

The present invention relates to antenna systems in general, and to splashplate antennae in particular.

2. Brief Description of Related Developments

Splashplate antenna systems, which can operate as both receiving and transmitting antennae, normally contain a parabolic-shaped main reflector and a feed assembly. The feed assembly for a "splashplate" type antenna at least includes a sub-reflector sometimes referred to as a "splash plate" or "splashplate," located at one end of a circular waveguide ("waveguide") that is open in front of the splashplate, and a waveguide "T" or an orthomode transducer attached to the other end of the waveguide for processing primary antenna beams. Received signals are reflected from the main reflector to the sub-reflector (splashplate) and then to the waveguide. Transmitted signals generated by the transmission circuitry attached thereto are converted to circularly polarized waves, carried to the splashplate by the circular waveguide and reflected from the sub-reflector and the main reflector to form a secondary antenna beam.

While sub-reflector feed antennae types such as Cassegrain and Gregorian are superior to splashplate feed antennae in electrical performance, the splashplate types are preferable in many systems because of their light weight (facilitating rapid scan operations), relative low construction cost, and low blockage of primary antenna aperture because the sub-reflectors can be relatively small. It is therefore desirable to solve some of their problems. For example, many splashplate feed antennae produce poor illumination of both the sub-reflector and the parabolic reflector that results in a high spillover of antenna beams and lower efficiency. Additionally, such antennae may also generate sidelobes with undesirable energy content, as well as unacceptably high levels of cross-polarization of the electrical and magnetic fields of the transmitted beams.

The reader is referred to FIGS. 1 and 2 which in general show splashplate antenna geometries and which specifically illustrate the geometry and feed configuration of an antenna based on the present invention. In a typical splashplate antenna feed the waveguide steps and the splashplate would be smaller than shown in FIG. 2 and the fields radiating from the waveguide would exhibit a power pattern such as shown in FIG. 3 that is based on the TE11 mode circular field pattern shown in FIG. 4. It will be apparent to those skilled in the art that the wide beamwidth and the curved field patterns shown in FIGS. 3 and 4 produce both significant spillover of the beam at the splashplate and cross-polarization in the radiated beam.

The larger feed and splash plate shown in FIG. 2 solve these problems by supporting both the TE11 and TM11 waveguide modes.

Given the above, it is desirable to provide a splashplate antenna system which embodies the aforementioned advantages sans the aforementioned disadvantages.

SUMMARY OF THE INVENTION

In view of the above-identified problems and limitations of the prior art, the present invention provides, in a feeder antenna system, a method of generating secondary antenna beams. The method at least includes the steps of providing a waveguide with multiple cross-sections of different diameters along a propagation axis, and providing a splashplate placed near the waveguide having multiple cross-sections of different diameters normal to the direction of the axis of propagation through the waveguide. The method further at least includes the steps of converting input waveguide signals into multiple waveguide modes, to create Gaussian-like field intensities, and radiating waves from the waveguide against the splashplate, wherein the waves reflected by the splashplate to a main reflector retain their polarization characteristics.

The present invention also provides a splashplate antenna at least including a main reflector, a feed waveguide coupled at a first end to the main reflector and at a second end to the feed horn and splashplate. The waveguide at least includes internally, a series of different dimensioned cross-sections along the axis of propagation causing input signals to be converted into multiple waveguide modes, to create Gaussian-like field patterns. The splashplate at least includes a series of normal faces with different dimensioned cross-sections causing waves received from the waveguide to retain their polarization pattern and to optimally illuminate the main reflector.

The present invention is described in detail below, with reference to the drawings.

BRIEF DESCRIPTION OF THE DRAWINGS

Features and advantages of the present invention will become apparent to those skilled in the art from the following description with reference to the drawings, in which.

DETAILED DESCRIPTION OF THE PREFERRED EMBODIMENT(S)

To eliminate the problems identified in the sections above, the present invention provides a method for establishing splashplate antenna geometries that novelly cause multi-mode waveguide field patterns.

Using advanced hybrid mode-matching and optimization software tools, the present invention configures the internal geometry of a waveguide by adding a series of different size cross-sections (variable geometry walls) that result in multiple mode patterns in the waves emitted from the waveguide. In the preferred embodiment, the walls of the waveguide are stepped or tapered with the aid of a Teflon adapter, fortified at some cross-section locations to create the variable geometry.

Figure 1:
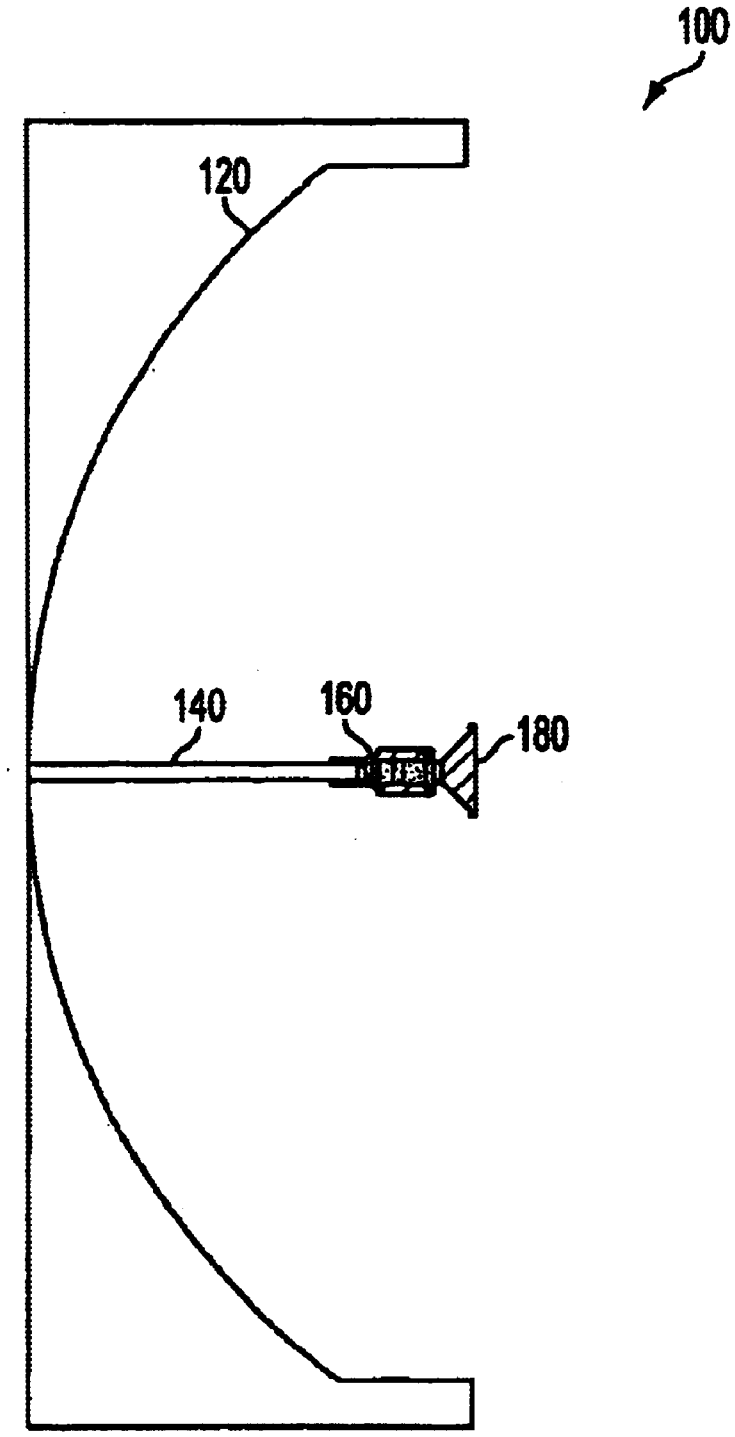
FIG. 1 is a side view of one embodiment of a splashplate/sub-reflector antenna system incorporating features of the present invention.
Figure 2:
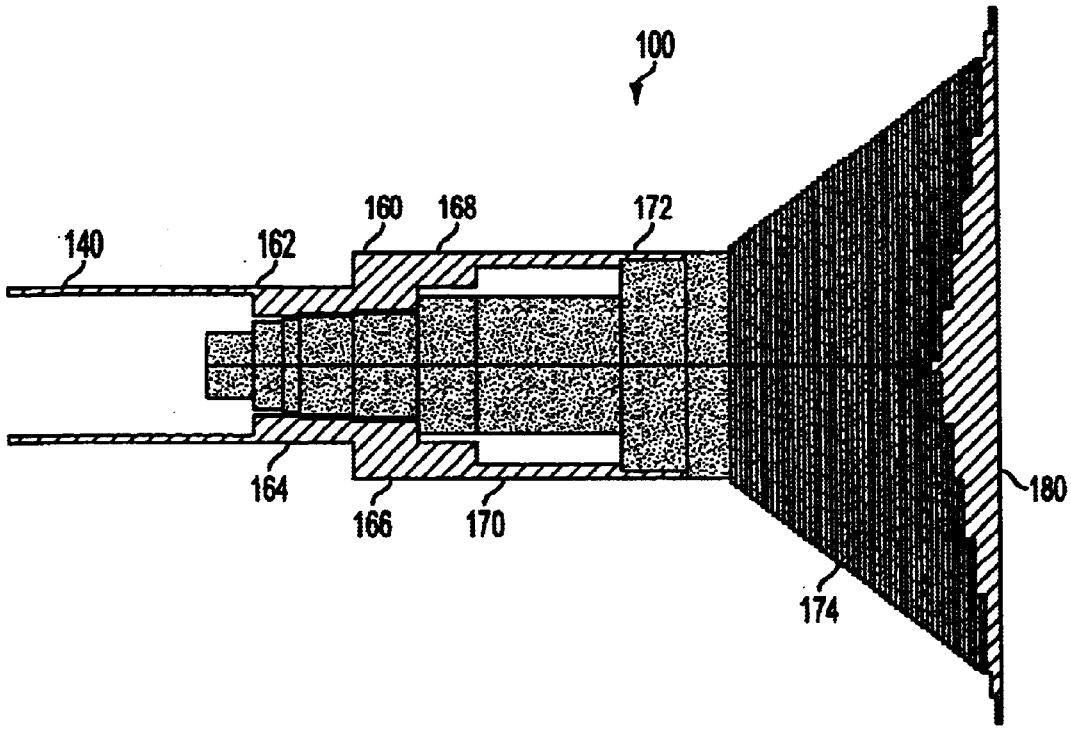
FIG. 2 is an enlarged side view of the waveguide and splashplate assemblies of one embodiment of a splashplate/sub-reflector antenna system incorporating features of the present invention.
Figure 3:
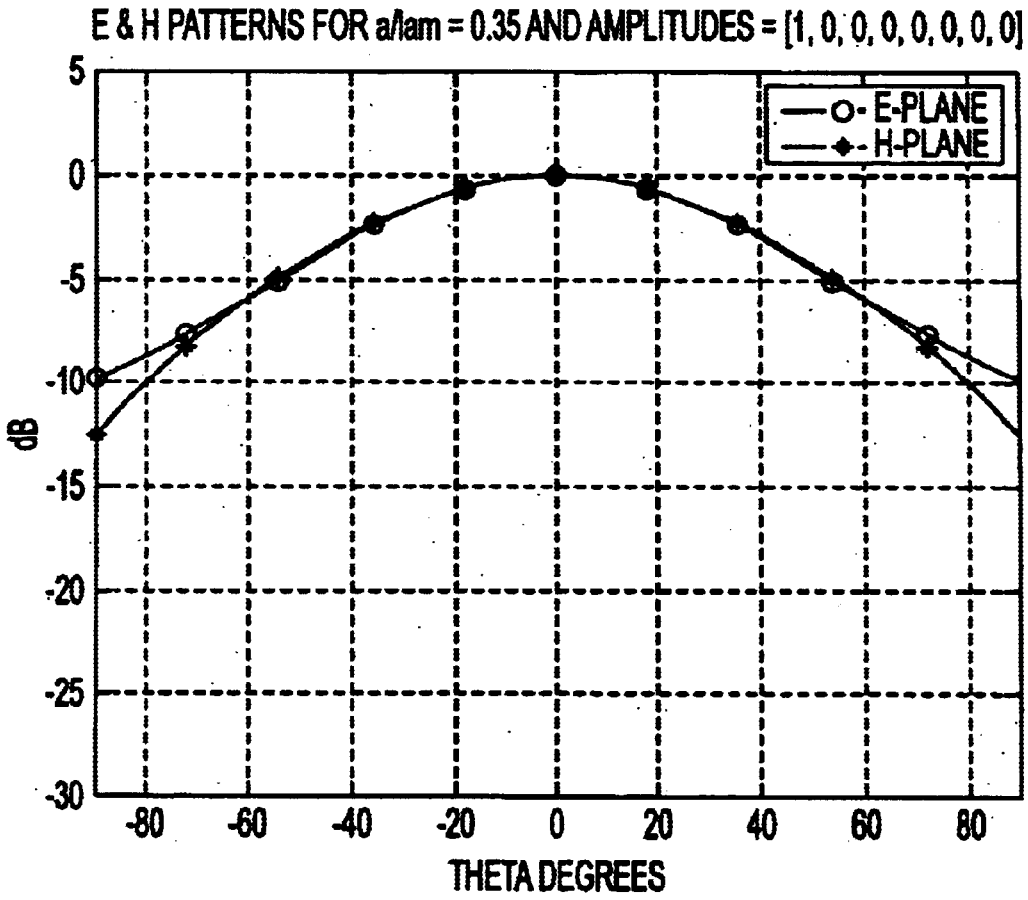
FIG. 3 is a graph of a radiation pattern created by a typical splashplate waveguide feed using the TE11 mode.
Figure 4A:
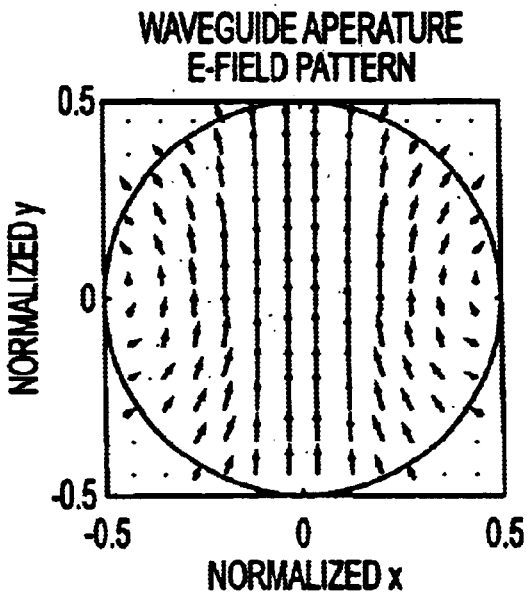
FIG. 4 is a representation of the transverse E- and H-field patterns of the TE11 waveguide mode in the example of FIG. 3.
Figure 4B:
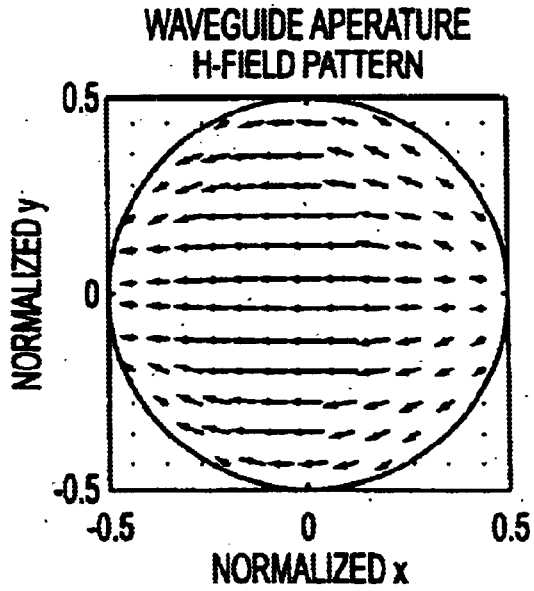

The present-inventive splashplate antenna 100 is generally shown in FIG. 1. The main components are a parabolic reflector 120, a feeder waveguide tube 140 generically representing the transmission circuitry needed to carry signals for transmission by the antenna as a secondary beam, a waveguide feed horn 160, and a sub-reflector or "splashplate" 180. FIG. 2 shows an enlarged side view of the waveguide and splashplate assemblies.

From FIG. 2 it is seen that the wall of the waveguide 160 generally has increasing cross-sectional area in the direction of wave propagation toward the metal splashplate 180. Several sections of the waveguide 160 can be seen numbered 162 through 172. This pattern and similar ones, have been found by the inventors to novelly create multiple waveguide modes that exit the waveguide 160. The geometry of the splashplate 180 is optimized for retaining the multiple mode characteristics of the beams received from the waveguide 160. In the preferred embodiment, the splashplate 180 can include a series of circular cross-section area regions or a continuous taper increasing in diameter in the direction of wave propagation from the waveguide to the splashplate when the antenna is producing secondary beams. A supporting dielectric 174 running through the throat of the horn 160 and extending out to the surface of the splash plate 180 is independently stepped in diameter to assist in the mode conversion and control through the horn 160 and out to the surface of the splashplate 180.

Figure 5:
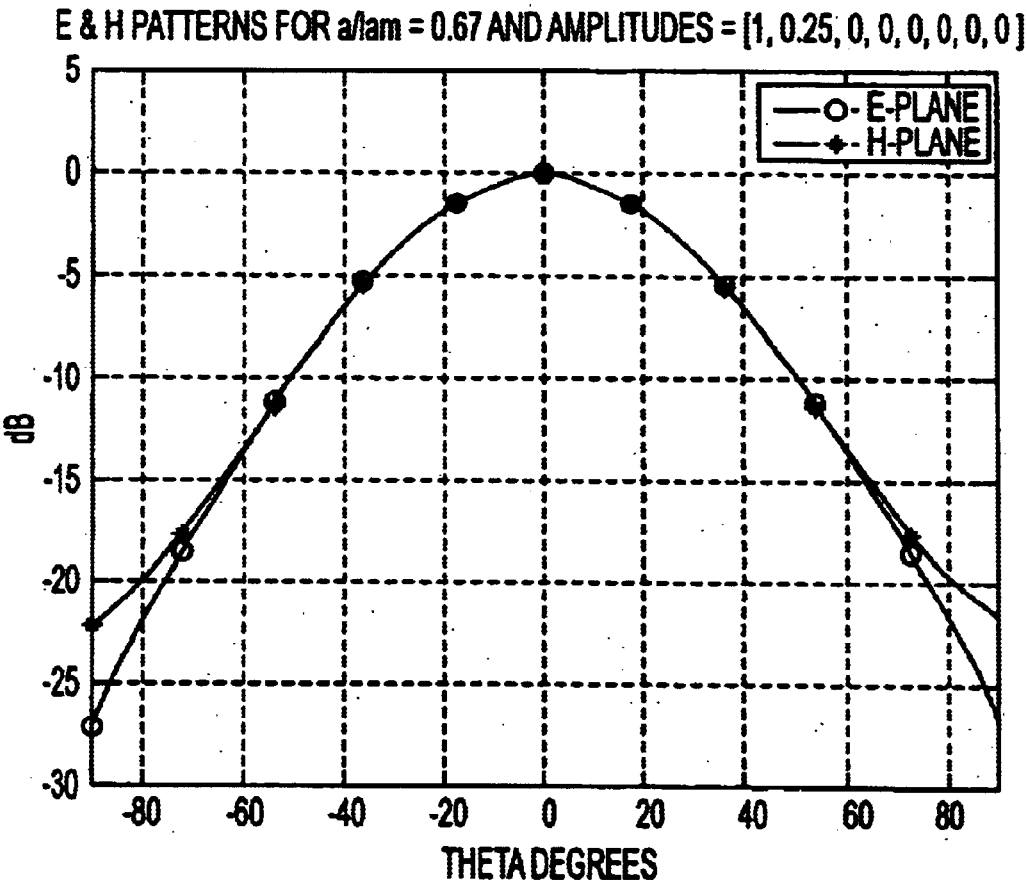
FIG. 5 is a graph of a radiation pattern created by the feed horn of one embodiment of a splashplate antenna constructed according to the present invention producing an output combination of TE11 and TM11 modes.
Figure 6A:
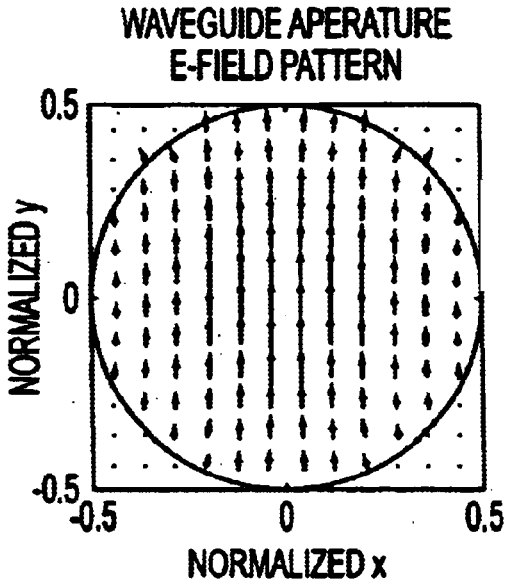
FIG. 6 is a representation of the transverse E- and H-field patterns created by the present-inventive splashplate waveguide for the combined TE11 and TM11 modes in the example of FIG. 5.
Figure 6B:
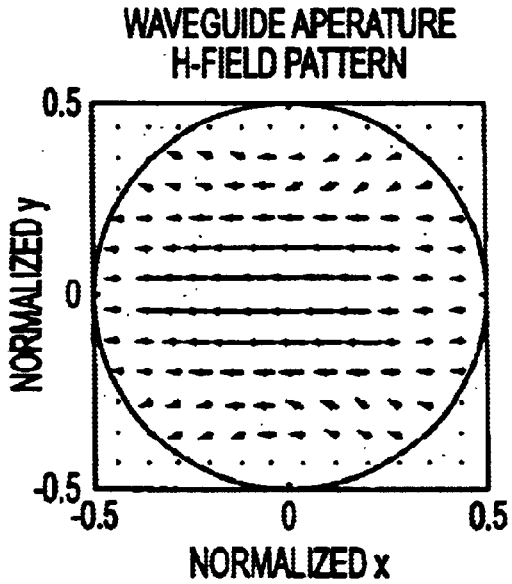

In one embodiment of the present invention, exemplified by FIGS. 5 and 6, the present-inventive antenna produces a secondary beam with TE11 and TM11 modes, and a Gaussian-like waveguide output aperture field pattern. As illustrated in FIG. 5, this arrangement produces an RF beam (based on the waveguide exit aperture fields) optimized for 100 degrees (at −10 decibels) with an exit waveguide radius of 0.671 wavelengths, where the dimension is based on the empty space wavelength of the transmitted beam. Those skilled in the art to which the present invention pertains will also understand that the aperture fields shown in FIG. 6 are also conducive to low cross-polarization in the transmitted beam.

Figure 7:
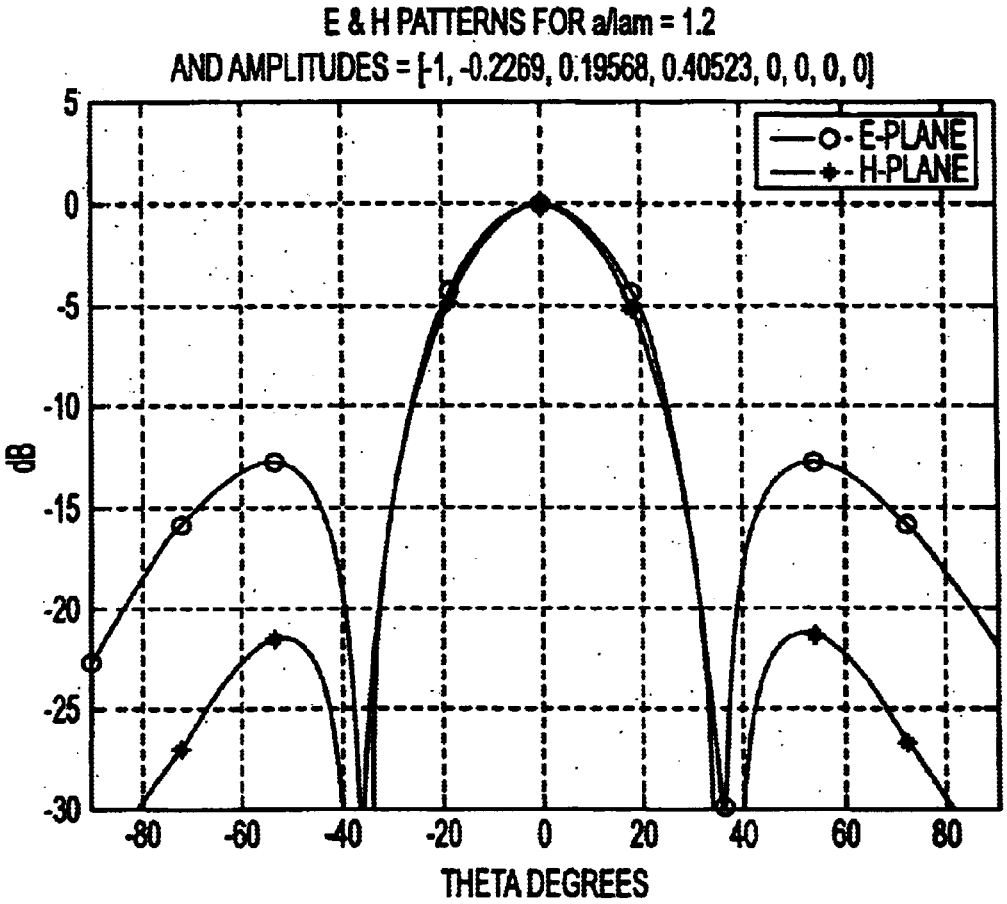
FIG. 7 is a graph of a multi-mode radiation pattern created by the feed horn of the present invention producing TE11, TM11, TE12, and TM12 modes.
Figure 8A:
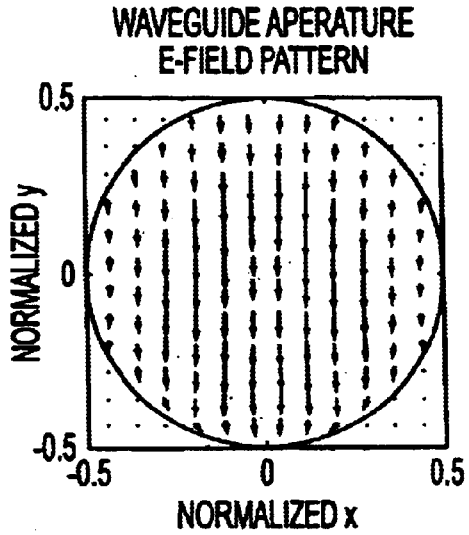
FIG. 8 is a representation of the transverse E- and H-field patterns created in the present-inventive waveguide for the TE11, TM11, TE12, and TM12 modes in the example of FIG. 7.
Figure 8B:
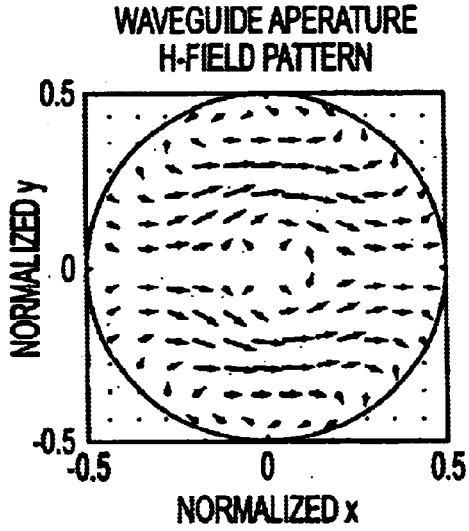

In another embodiment of the present invention, represented by FIGS. 7 and 8, the waveguide geometry is such that four waveguide modes (TE11, TM11, TE12 and TM12) are included in the waveguide aperture beam. From the aforementioned drawing figures, it is seen that the waveguide aperture beam contains a donut-shaped field distribution optimized for a 50-degree beam width (at −11 decibels), and having a waveguide aperture radius of 1.2 wavelengths. It is anticipated that the donut-shaped field pattern would greatly reduce reflections of the exit beam back into the waveguide (a problem in the prior art).

It will be appreciated by those skilled in the art that other polarization mode combinations are possible, given the teachings of the present invention, and the revelation of the present invention that waveguide aperture beams in splashplate antennae need not be limited to one waveguide mode, but may in fact contain multiple waveguide modes.

Embodiments of the present invention generally improve the performance of splashplate antenna. The waveguide feed and splashplate reflector can be modified by enlarging the feed waveguide and/or tapering the wall profile in a manner that produces a multi-mode HE11-like (Gaussian-like) field pattern at the waveguide radiation point. When this pattern is radiated against the near-field splashplate, the circular pattern symmetry is retained with its low cross polarization characteristics. This improves the RF beam characteristics associated with the antenna.

To improve RF beam performance, mode-matching and optimization computer tools can be used to shape both the radiating waveguide and the splashplate. This can include maximizing the RF gain, minimizing the side-lobe levels, improving the spill over efficiency and improving the input waveguide match.

The present invention can generally provide low blockage due to the small sub-reflector, light weight for rapid scanning applications and low construction cost.

Variations and modifications of the present invention are possible, given the above description. However, all variations and modifications which are obvious to those skilled in the art to which the present invention pertains are considered to be within the scope of the protection granted by this Letters Patent.

What is claimed is:

1. In a feeder antenna system, a method of generating secondary antenna beams, said method comprising the steps of:

providing a waveguide having multiple cross-sections of different diameters along a propagation axis;

providing a splashplate placed near said waveguide having multiple cross-sections of different diameters normal to the direction of the axis of propagation through said waveguide;

converting input waveguide signals into multiple waveguide modes, to create Gaussian-like field patterns; and radiating waves from said waveguide against said splashplate, wherein the waves reflected by said splashplate to a main reflector retain their polarization characteristics.

2. The method of claim 1 wherein said multiple polarization modes include TE11 and TM11.

3. The method of claim 1 wherein said multiple polarization modes include TE11, TM11, TE12 and TM12.

4. The method of claim 1, wherein the diameters of said cross-sections in said waveguide vary along an axis in the direction of said splashplate.

5. The method of claim 1, wherein the diameters of said cross-sections of said splashplate increase along an axis in the direction away from said waveguide.

6. A splashplate antenna comprising:

a main reflector;

a feed waveguide coupled at a first end to said main reflector;

a feed horn coupled to a second end of said feed waveguide; and a splashplate coupled to said waveguide at the same end as said feed horn;

wherein said waveguide comprises internally, a series of different dimensioned cross-sections along the axis of propagation causing input signals to be converted into multiple waveguide modes, to create Gaussian field shapes; and wherein said splashplate comprises a series of normal faces with different dimensioned cross-sections causing, waves received from said waveguide to retain their polarization pattern and to be optimally distributed over the main reflector.

7. The antenna of claim 6 wherein said multiple waveguide modes include TE11 and TM11.

8. The antenna of claim 6 wherein said multiple waveguide modes include TE11, TM11, TE12 and TM12.

9. The antenna of claim 6, wherein the diameters of said cross-sections in said waveguide vary along an axis in the direction of said splashplate.

10. The antenna of claim 6, wherein the diameters of said cross-sections of said splashplate increase along an axis in the direction away from said waveguide.

* * * * *